US008186336B2

(12) United States Patent
Meyer et al.

(10) Patent No.: US 8,186,336 B2
(45) Date of Patent: May 29, 2012

(54) FUEL CONTROL SYSTEM AND METHOD FOR IMPROVED RESPONSE TO FEEDBACK FROM AN EXHAUST SYSTEM

(75) Inventors: Jason Meyer, Dayton, OH (US); Shawn W. Midlam-Mohler, Columbus, OH (US); Kenneth P. Dudek, Rochester Hills, MI (US); Stephen Yurkovich, Columbus, OH (US); Yann G. Guezennec, Upper Arlington, OH (US)

(73) Assignee: GM Global Technology Operations LLC

( * ) Notice: Subject to any disclaimer, the term of this patent is extended or adjusted under 35 U.S.C. 154(b) by 385 days.

(21) Appl. No.: 12/624,779

(22) Filed: Nov. 24, 2009

(65) Prior Publication Data

US 2011/0077845 A1 Mar. 31, 2011

Related U.S. Application Data

(60) Provisional application No. 61/246,697, filed on Sep. 29, 2009.

(51) Int. Cl.
*F02D 41/00* (2006.01)

(52) U.S. Cl. ..... 123/695; 123/696

(58) Field of Classification Search ..... 123/672, 123/674, 693, 694, 695, 696
See application file for complete search history.

(56) References Cited

U.S. PATENT DOCUMENTS

| | | | | |
|---|---|---|---|---|
| 4,099,491 | A * | 7/1978 | Reddy | 123/696 |
| 4,214,558 | A * | 7/1980 | Nishioka et al. | 123/696 |
| 4,241,710 | A * | 12/1980 | Peterson et al. | 123/680 |
| 4,481,908 | A * | 11/1984 | Iida | 123/406.44 |
| 4,502,443 | A * | 3/1985 | Hasegawa et al. | 123/686 |
| 4,889,099 | A * | 12/1989 | Tomishawa | 123/674 |
| 5,761,901 | A * | 6/1998 | Staufenberg et al. | 60/274 |
| 5,787,867 | A * | 8/1998 | Schnaibel et al. | 123/674 |
| 5,836,153 | A * | 11/1998 | Staufenberg et al. | 60/274 |
| 5,941,223 | A * | 8/1999 | Kato | 123/679 |
| 6,026,795 | A * | 2/2000 | Poggio et al. | 123/695 |
| 6,286,494 | B1 * | 9/2001 | Ishii et al. | 123/696 |
| 6,520,168 | B2 * | 2/2003 | Ishii et al. | 123/695 |
| 6,711,892 | B2 * | 3/2004 | Tamura et al. | 60/277 |
| 7,500,354 | B2 * | 3/2009 | Pohmerer et al. | 60/285 |
| 2006/0277896 | A1 * | 12/2006 | Gehret, Jr. | 60/274 |

* cited by examiner

*Primary Examiner* — Thomas Moulis

(57) ABSTRACT

An engine control system includes a proportional correction module and a variable proportional gain determination module. The proportional correction module generates a proportional correction for a fuel command to an engine based on a variable proportional gain and a difference between expected and measured amounts of oxygen in exhaust gas produced by the engine. The variable proportional gain determination module determines the variable proportional gain based on a nominal gain and an amount of time since a polarity of the difference has changed, wherein the nominal gain is based on engine operating parameters.

20 Claims, 5 Drawing Sheets

FUEL CONTROL SYSTEM AND METHOD FOR IMPROVED RESPONSE TO FEEDBACK FROM AN EXHAUST SYSTEM

CROSS-REFERENCE TO RELATED APPLICATIONS

This application claims the benefit of U.S. Provisional Application No. 61/246,697, filed on Sep. 29, 2009. The disclosure of the above application is incorporated herein by reference in its entirety.

FIELD

The present disclosure relates to internal combustion engines, and more particularly to a fuel control system and method for improved response to feedback from exhaust gas oxygen (EGO) sensors in an exhaust system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within cylinders to drive pistons and generate drive torque. A ratio of air to fuel in the A/F mixture may be referred to as an A/F ratio. The A/F ratio may be regulated by controlling at least one of a throttle and a fuel control system. The A/F ratio, however, may also be regulated by controlling other engine components (e.g., an exhaust gas recirculation, or EGR, system). For example, the A/F ratio may be regulated to control torque output of the engine and/or to control emissions produced by the engine.

The fuel control system may track a trajectory of a signal corresponding to a desired A/F ratio. The trajectory, however, may affect disturbance rejection performance and/or emissions reduction. For example, the trajectory may be a periodic sinusoidal signal. Therefore, the fuel control system may include an inner feedback loop and an outer feedback loop to improve tracking of the trajectory while maintaining disturbance rejection performance.

More specifically, the inner feedback loop may use data from an exhaust gas oxygen (EGO) sensor located upstream from a catalytic converter in an exhaust system of the engine system (i.e., a pre-catalyst EGO sensor). The inner feedback loop may use the data from the pre-catalyst EGO sensor to control a desired amount of fuel supplied to the engine (i.e., a fuel command).

For example, the inner feedback loop may decrease the fuel command when the pre-catalyst EGO sensor senses a rich A/F ratio in exhaust gas produced by the engine (i.e., non-burnt fuel vapor). Alternatively, for example, the inner feedback loop may increase the fuel command when the pre-catalyst EGO sensor senses a lean A/F ratio in the exhaust gas (i.e., excess oxygen). In other words, the inner feedback loop may maintain the A/F ratio at or near an ideal A/F ratio (e.g., stoichiometry, or 14.7:1), thus increasing the fuel economy of the engine and/or decreasing emissions produced by the engine.

Specifically, the inner feedback loop may perform proportional-integral (PI) control to correct the fuel command. Moreover, the fuel command may be further corrected based on a short term fuel trim or a long term fuel trim. For example, the short term fuel trim may correct the fuel command by changing gains of the PI control. Additionally, for example, the long term fuel trim may correct the fuel command when the short term fuel trim is unable to fully correct the fuel command within a desired time period.

The outer feedback loop, on the other hand, may use information from an EGO sensor arranged after the catalytic converter (i.e., a post-catalyst EGO sensor). The outer feedback loop may use data from the post-catalyst EGO sensor to correct (i.e., calibrate) an unexpected reading from the pre-catalyst EGO sensor, the post-catalyst EGO sensor, and/or the catalytic converter. For example, the outer feedback loop may use the data from the post-catalyst EGO sensor to maintain the post-catalyst EGO sensor at a desired voltage level. In other words, the outer feedback loop may maintain a desired amount of oxygen stored in the catalytic converter, thus improving the performance of the exhaust system. Additionally, the outer feedback loop may control the inner feedback loop by changing thresholds used by the inner feedback loop in determining whether the A/F ratio is rich or lean.

Exhaust gas composition (e.g., A/F ratio) may affect the behavior of the EGO sensors, thereby affecting accuracy of the EGO sensor values. As a result, fuel control systems have been designed to operate based on values that are different than expected. For example, fuel control systems have been designed to operate "asymmetrically." In other words, for example, the error response to a lean A/F ratio may be different than the error response to a rich A/F ratio.

The asymmetry is typically designed as a function of engine operating parameters. Specifically, the asymmetry is a function of the exhaust gas composition, and the exhaust gas composition is a function of the engine operating parameters. The asymmetry is achieved indirectly by adjusting the gains and the thresholds of the inner feedback loop, requiring numerous tests at various engine operating conditions. Moreover, this extensive calibration is required for each powertrain and vehicle class and does not easily accommodate other technologies, including, but not limited to, variable valve timing and lift.

SUMMARY

An engine control system includes a proportional correction module and a variable proportional gain determination module. The proportional correction module generates a proportional correction for a fuel command to an engine based on a variable proportional gain and a difference between expected and measured amounts of oxygen in exhaust gas produced by the engine. The variable proportional gain determination module determines the variable proportional gain based on a nominal gain and an amount of time since a polarity of the difference has changed, wherein the nominal gain is based on engine operating parameters.

A method includes generating a proportional correction for a fuel command to an engine based on a variable proportional gain and a difference between expected and measured amounts of oxygen in exhaust gas produced by the engine, and determining the variable proportional gain based on a nominal gain and an amount of time since a polarity of the difference has changed, wherein the nominal gain is based on engine operating parameters.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
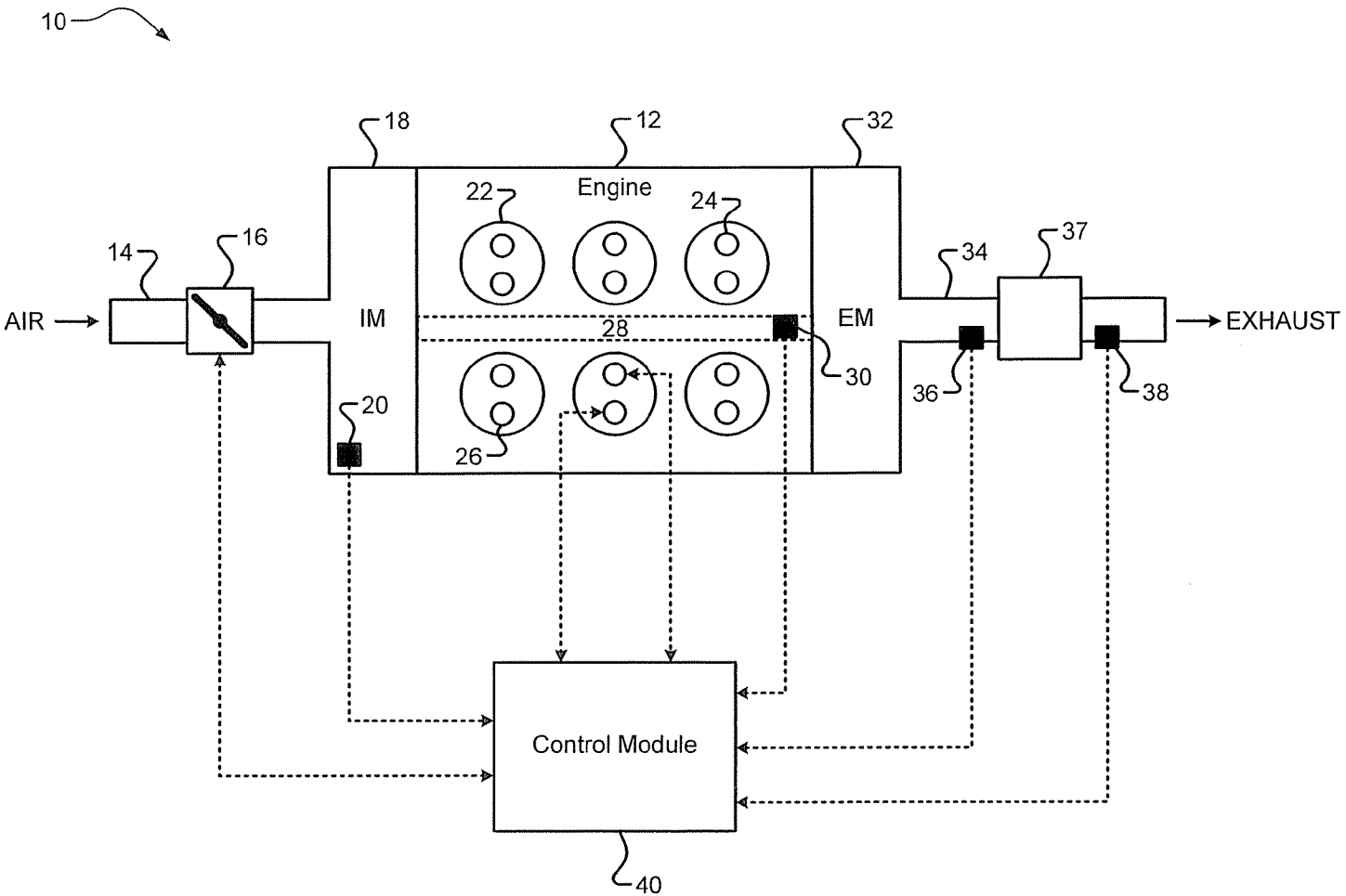
FIG. 1 is a functional block diagram of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A desired amount of fuel to be supplied to an engine (i.e., a fuel command) may be adjusted based on feedback from an exhaust gas oxygen (EGO) sensor upstream from a catalytic converter (i.e., a pre-catalyst EGO sensor). For example, the fuel command may include control signals for a plurality of fuel injectors corresponding to the desired amount of fuel. The feedback may be a difference (i.e., error) between expected and actual amounts of oxygen in exhaust gas produced by the engine. More specifically, the feedback may be a voltage ($V_{err}$) indicating a difference between expected measurements from the pre-catalyst EGO sensor (based on the fuel command) and actual measurements from the pre-catalyst EGO sensor.

A control module may perform proportional-integral (PI) control of the fuel command based on the voltage $V_{err}$. Rather, the fuel command may be adjusted using a proportional correction and an integral correction, both of which are derived from the voltage $V_{err}$. For example, the PI control may adjust the fuel command based on a weighted sum of the proportional correction and the integral correction.

More specifically, the proportional correction may include a product of the voltage $V_{err}$ and a proportional gain (P). The proportional correction may provide faster correction to the fuel command in response to changes in the voltage $V_{err}$. The integral correction, on the other hand, may include an integral of a product of the voltage $V_{err}$ and an integral gain (I). The integral correction may improve accuracy of the fuel command by decreasing the average steady-state error.

Selecting the proportional gain P for the PI control scheme, however, has both advantages and disadvantages. More specifically, a large proportional gain P typically results in faster recovery from disturbances in the voltage $V_{err}$ but poor steady-state tracking. Similarly, a small proportional gain P typically achieves better steady-state tracking, but a slower response. Therefore, typical engine control systems may perform PI control of the fuel command using moderate proportional gain P to balance the advantages and disadvantages. A moderate proportional gain P, however, may result in decreased fuel economy and/or increased emissions. Moreover, the integral correction may result in large oscillations during large disturbances (due to over-correction), thus increasing settling times further.

The settling time of the system may also depend on a magnitude of the integral gain I. In other words, as the integral gain I increases, the convergence rate of the system increases. Increasing the integral gain I, however, may also increase a magnitude of over-correction (i.e., over-shoot) due to the plant delay ($d_p$). Thus, while the system may have an average steady-state error of zero, other statistics (e.g., standard deviation) may increase. A moderate integral gain I, however, may also result in decreased fuel economy and/or increased emissions (similar to a moderate proportional gain P, described above).

Therefore, a system and method is presented that performs PI control of the fuel command using a variable proportional gain ($P_v$) and a transfer operation for the PI control scheme. The variable proportional gain $P_v$ includes a nominal gain component based on engine operating parameters and a proportional gain component based on a time (in number of engine cycles) since a polarity of the voltage $V_{err}$ has changed. Specifically, the nominal gain component is relatively small to improve steady-state tracking performance. The proportional gain component, on the other hand, increases proportionally with the magnitude of the disturbance in the voltage $V_{err}$ and/or the time since the polarity of the voltage $V_{err}$ has changed. The proportional gain component, therefore, may reduce settling times. Furthermore, one or more components of the PI control scheme may be transferred (i.e., exchanged) when a polarity of the voltage $V_{err}$ changes, which may further reduce settling times and prevent over-correction.

Referring now to FIG. 1, an engine system 10 includes an engine 12. Air is drawn into an intake manifold 18 through an air inlet 14 that may be regulated by a throttle 16. Air pressure in the intake manifold 18 may be measured by a manifold pressure (MAP) sensor 20. The air in the intake manifold may be distributed through intake valves (not shown) into a plurality of cylinders 22. While six cylinders are shown, it can be appreciated that other numbers of cylinders may be implemented.

Fuel injectors 24 inject fuel into the cylinders 22 to create an air/fuel (A/F) mixture. For example, the fuel injectors 24 may be actuated based on the fuel command. While fuel injectors 24 are implemented in each of the cylinders 22 (i.e. direct fuel injection), it can be appreciated that one or more port injectors (not shown) may inject fuel into one or more ports of the cylinders 22, respectively (i.e. port fuel injection). The A/F mixture in the cylinders 22 is compressed by pistons (not shown) and ignited by spark plugs 26. The combustion of the A/F mixture drives the pistons (not shown), which rotatably turns a crankshaft 28 generating drive torque. An engine speed sensor 30 may measure a rotational speed of the crankshaft 28 (e.g., in revolutions per minute, or RPM).

Exhaust gas resulting from combustion is vented from the cylinders 22 through exhaust valves (not shown) and into an exhaust manifold 32. An exhaust system 34 includes a catalytic converter 37 that treats the exhaust gas to reduce emissions. The exhaust system 34 may then expel the treated exhaust gas from the engine 12. A pre-catalyst EGO sensor 36 generates a first EGO signal based on an amount of oxygen in the exhaust gas upstream from (i.e., before) the catalytic converter 37. A post-catalyst EGO sensor 38 generates a second EGO signal based on an amount of oxygen in the exhaust gas downstream from (i.e. after) the catalytic converter 37.

For example only, the EGO sensors 36, 38 may include, but are not limited to, switching EGO sensors or universal EGO (UEGO) sensors. The switching EGO sensors generate an EGO signal in units of voltage and switch the EGO signal to a low or a high voltage when the oxygen concentration level is lean or rich, respectively. The UEGO sensors may generate an EGO signal in units of A/F equivalence ratio (EQR) and eliminate the switching between lean and rich oxygen concentration levels of the switching EGO sensors.

A control module 40 receives the MAP signal, the engine speed (RPM) signal, and the first and second EGO signals from the pre-catalyst EGO sensor 36 and the post-catalyst EGO sensor 38, respectively. The control module 40 regulates operation of the engine system 10. More specifically, the control module 40 may control at least one of air, fuel, and spark supplied to the engine 12. For example, the control module 40 may regulate airflow into the engine 12 by controlling the throttle, fuel supplied to the engine 12 (the fuel command) by controlling the fuel injectors 24, and spark supplied to the engine 12 by controlling the spark plugs 26.

The control module 40 may also implement the system and method of the present disclosure. More specifically, the control module 40 may perform PI control of the fuel command using the variable proportional gain P, and the transfer operation for the PI control scheme according to the present disclosure.

Figure 2:
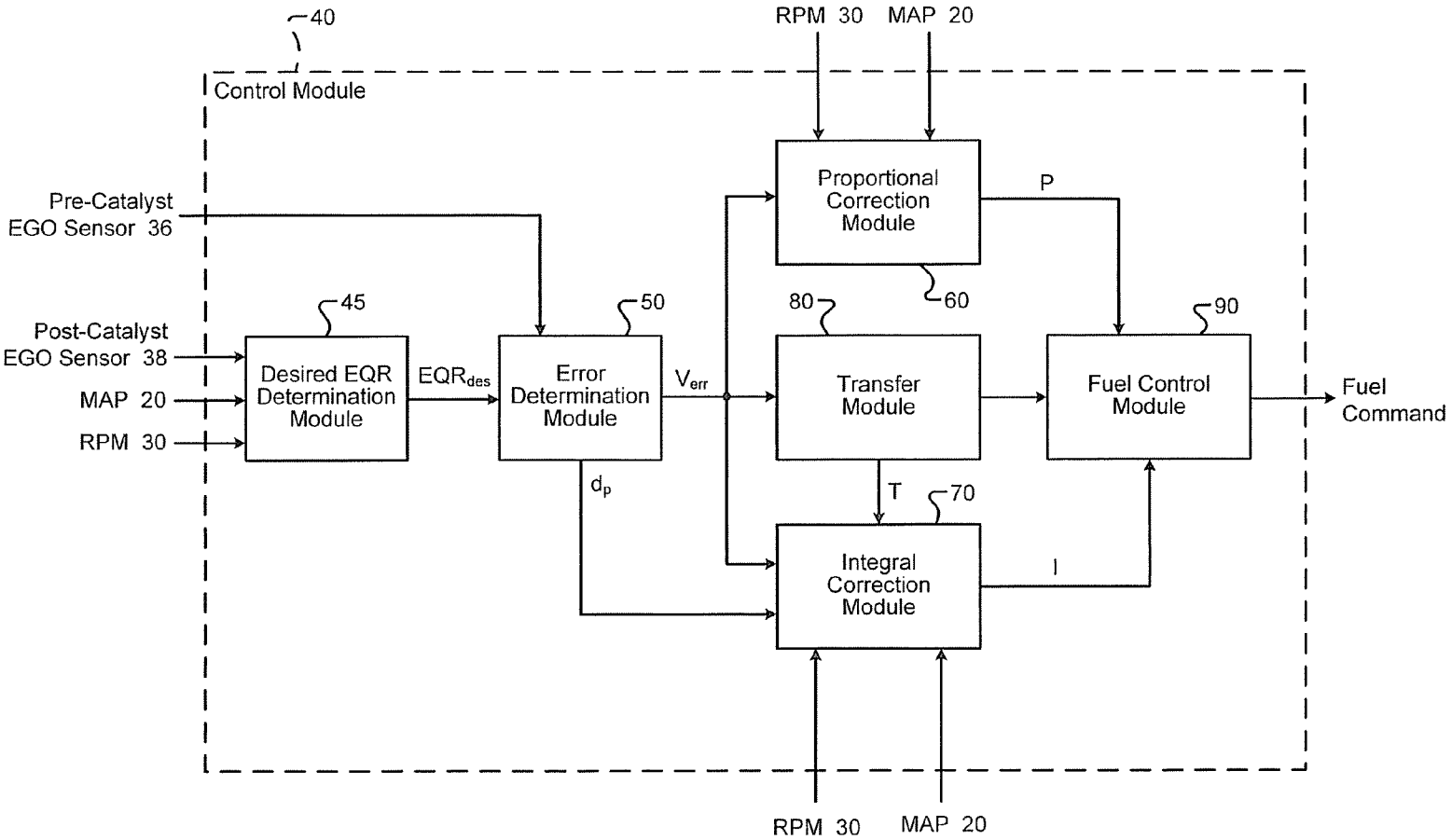
FIG. 2 is a functional block diagram of an exemplary control module according to the present disclosure.

Referring now to FIG. 2, the control module 40 is shown in more detail. The control module 40 may include a desired equivalence ratio (EQR) determination module 45, an error determination module 50, a proportional correction module 60, an integral correction module 70, a transfer module 80, and a fuel control module 90.

The desired EQR determination module 45 determines a desired EQR $EQR_{des}$ based on various engine operating parameters. For example, the various engine operating parameters may include, but are not limited to MAP (e.g., from the MAP sensor 20), engine speed (e.g., from the RPM sensor 30), and post-catalyst EGO concentration (e.g., from the post-catalyst EGO sensor 38). Additionally, for example, the desired EQR signal $EQR_{des}$ may be a periodic signal with period $T_d$.

The error determination module 50 receives the pre-catalyst EGO measurement from the pre-catalyst EGO sensor 36. The error determination module 50 also receives the desired EQR $EQR_{des}$ from the desired EQR determination module 45. The error determination module 50 determines an expected EGO measurement based on the desired EQR $EQR_{des}$. For example, a look-up table may include a plurality of expected EGO measurements corresponding to different desired EQR values. The error determination module 50 may determine an error based on pre-catalyst EGO measurement (i.e. an actual EGO measurement) and the expected EGO measurement.

For example, the error may be the voltage $V_{err}$. More specifically, the voltage $V_{err}$ may indicate a difference between the expected EGO measurement and the actual EGO measurement (e.g., expected−actual). The error determination module 50 may also determine an estimated plant delay $d_p$ based on a delay between the fuel command and a corresponding measurement from the pre-catalyst EGO sensor 36. For example only, the estimated plant delay may be determined using a lookup table relating estimated plant delay to MAP and/or mass air flow (MAF) rate.

The proportional correction module 60 receives the voltage $V_{err}$ from the error determination module 50. The proportional correction module 60 also receives signals indicative of various engine operating parameters. For example, the proportional correction module 60 may receive signals from the MAP sensor 20 and the RPM sensor 30, indicative of intake manifold pressure and engine speed, respectively. However, signals indicative of other engine operating parameters may be received by the proportional correction module 60 (e.g., percentage of exhaust gas recirculation, or EGR, or a position of an EGR valve).

The proportional correction module 60 generates a proportional correction for the fuel command that is received by the fuel control module 90. In one embodiment, the proportional correction module 60 may include an additional module (not shown) that generates the variable proportional gain $P_v$ (e.g., a variable proportional gain generation module). However, the proportional correction module 60 may also generate the variable proportional gain $P_v$.

The proportional correction module 60 may generate the proportional correction P based on the voltage $V_{err}$ and the variable proportional gain ($P_v$). For example, the proportional correction P may be generated as follows:

$$P=P_v\times V_{err} \tag{1}$$

The variable proportional gain $P_v$, for example, may then be generated as follows:

$$P_v=K_{nom}(MAP,RPM)+K_v\times D_1(n) \tag{2}$$

where $K_{nom}$ is a nominal gain component (a function of engine operating parameters) and the other quantity $[K_v\times D_1(n)]$ is the variable proportional gain component. More specifically, $D_1$ is a first deadzone function, n is the time (in number of engine events) since the polarity of the voltage $V_{err}$ has changed, and $K_v$ is the gain of the variable proportional gain component. Thus, the variable proportional gain $P_v$ may be the nominal correction component $K_{nom}$ when the sign of the voltage $V_{err}$ changes (i.e., the variable proportional gain component may be zero).

The first deadzone function $D_1$ may be defined as follows:

$$D_1\left(n-\frac{T_d}{2}\right)=\begin{cases}0 & \text{if} \quad n<\frac{T_d}{2}\\ n-\frac{T_d}{2} & \text{else}\end{cases}, \tag{3}$$

where $T_d$ is a dither period and n is time (in number of engine events) since the polarity of the voltage $V_{err}$ has changed.

As shown above, the first deadzone function $D_1$ is zero until the number of engine events n exceeds one half of the dither period ($T_d/2$). In other words, when n is greater than one half of the dither period $T_d/2$, the first deadzone function $D_1$ is equal to the difference between the number of engine events since the polarity of the voltage Verr has changed and half the dither period $T_d/2$. Therefore, the variable proportional gain $P_v$ does not increase greater than the nominal gain component $K_{nom}$ when the voltage $V_{err}$ changes polarity more often than half the dither period $T_d/2$.

However, when the voltage $V_{err}$ does not change polarity after a number of engine events n equal to half the dither period $T_d/2$, then the variable proportional gain $P_v$ increases linearly with respect to the number of engine events n (via the first deadzone function $D_1$). Thus, large disturbances may be removed quickly (i.e. via the variable proportional gain component), while maintaining steady-state tracking performance (i.e. via the nominal gain component).

The integral correction module 70 also receives the voltage $V_{err}$. The integral correction module 70 may also receive a transfer signal (T) from the transfer module 80 and the estimated plant delay $d_p$ from the error determination module 50. The integral correction module 70 generates an integral correction I for the fuel command that is received by the fuel control module 90. The integral correction I may be combined with the proportional correction P to cancel disturbances. More specifically, the integral correction I may decrease the convergence time and improve steady-state tracking.

The integral correction module 70 may generate the integral correction I based on the voltage $V_{err}$ and an integral gain ($K_i$). For example, the integral correction I may be generated as follows:

$$I(k)=I(k-1)+K_i(MAP,RPM)\times V_{err}+K_v\times T\times D_2(n) \quad (4),$$

where k is a current time (in number of engine events), $K_1$ is the integral gain component (a function of engine operating parameters), $K_v$ is the gain of the variable component of the proportional correction P (previously described with respect to Equation 2), $D_2$ is a second deadzone function, and T is the transfer signal (from the transfer module 80).

The second deadzone function $D_2$ may be defined as follows:

$$D_2(n)=\begin{cases} 0 & \text{if} \quad n<\frac{T_d}{2}+d_p \\ n-\frac{T_d}{2}-d_p & \text{else} \end{cases}, \quad (5)$$

where $d_p$ is the estimated plant delay (i.e., the delay between the fuel command and a corresponding measurement from the pre-catalyst EGO sensor 36), and n is time (in number of engine events) since the polarity of the voltage $V_{err}$ has changed.

As shown above, the second deadzone function $D_2$ is zero until the number of engine events n exceeds one half of the dither period $T_d/2$ plus the estimated plant delay $d_p$. In other words, when n is greater than one half of the dither period $T_d/2$ plus the estimated plant delay dp, the second deadzone function $D_2$ is equal to the difference between n and one half of the dither period $T_d/2$ plus the estimated plant delay $d_p$.

The transfer module 80 also receives the voltage $V_{err}$. The transfer module 80 generates the transfer signal T based on the voltage $V_{err}$. More specifically, for example, the transfer signal T may be generated as follows:

$$T=\begin{cases} 1 & \text{if} \quad V_{err} \text{ changes polarity} \\ 0 & \text{else} \end{cases}. \quad (6)$$

In other words, the transfer signal T may set the third component of the integral correction I equal zero unless the transfer signal T is sent (see Equation 4). The transfer operation of the third component of the integral correction I may remove a ringing effect that may occur (see FIGS. 3A and 3B).

Figure 3A:
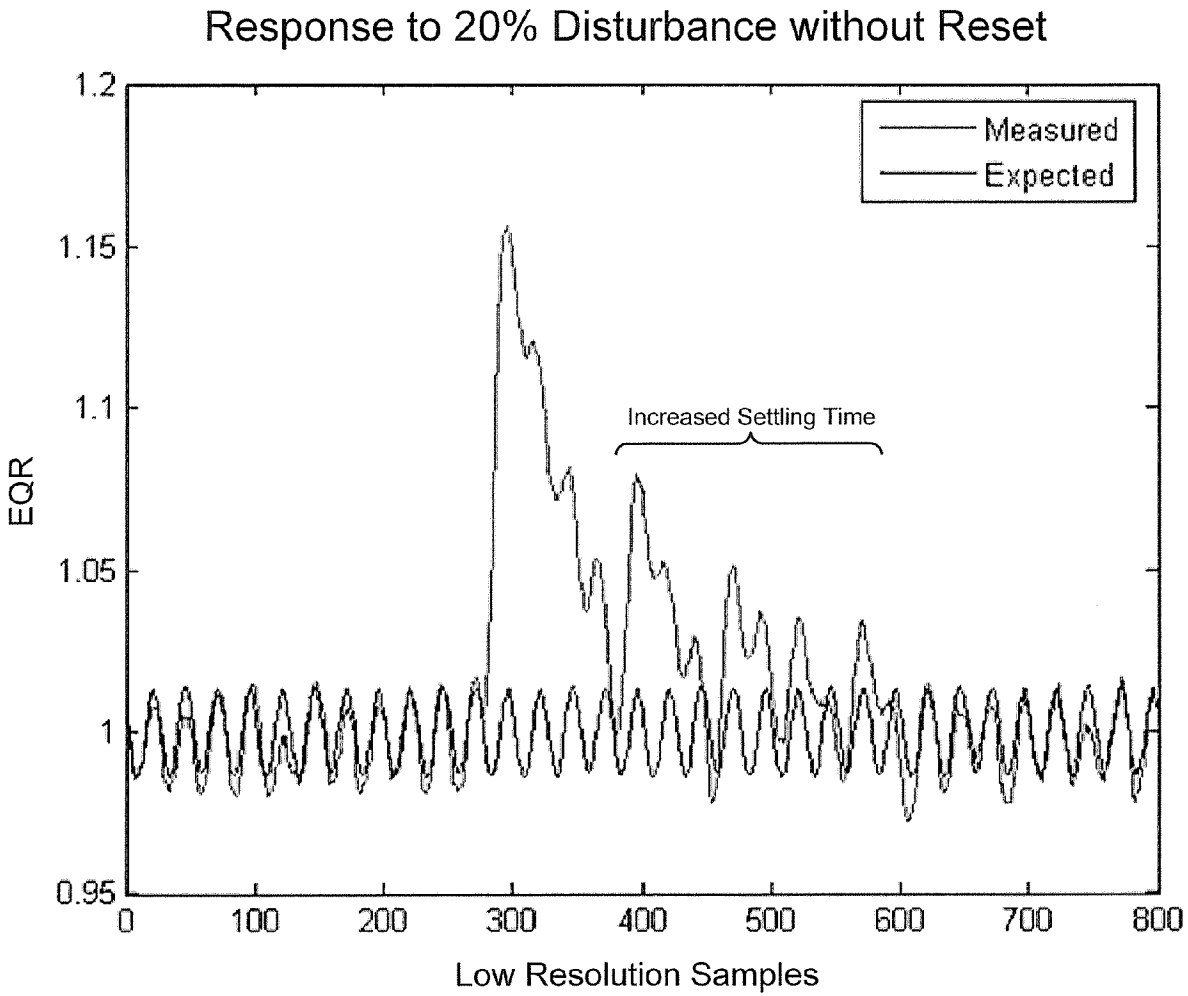
FIG. 3A is a graph illustrating exemplary proportional-integral (PI) control of an amount of fuel supplied to an engine in response to a disturbance without implementing the transfer module according to the present disclosure.
Figure 3B:
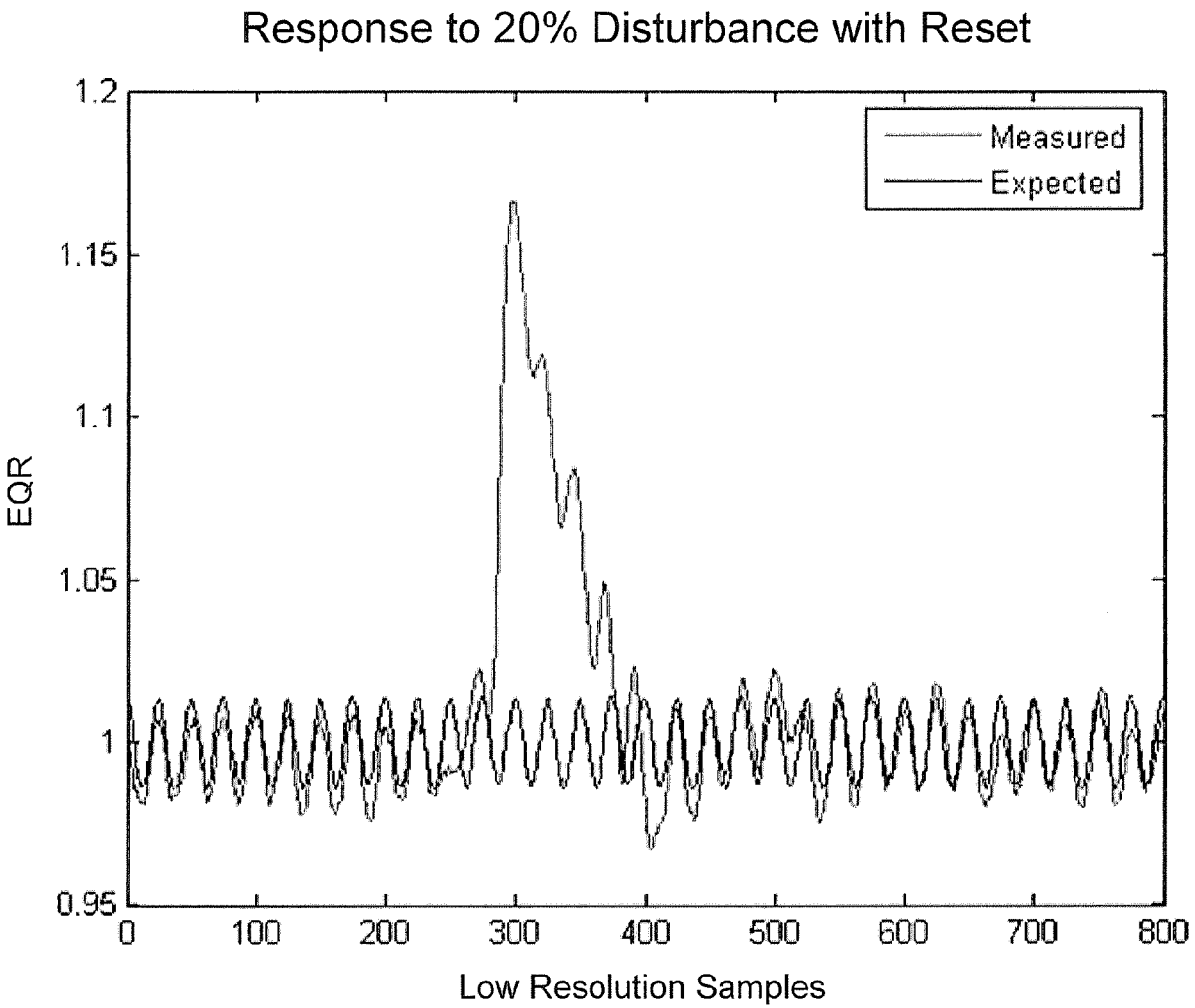
FIG. 3B is a graph illustrating exemplary PI control of an amount of fuel supplied to an engine in response to a disturbance with implementation of the transfer module according to the present disclosure.

Referring now to FIGS. 3A and 3B, effects of the transfer operation (i.e., the transfer module 80) in response to a disturbance are illustrated. More specifically, FIG. 3A illustrates the PI control of the fuel command in response to a 20% disturbance without the transfer operation of the present disclosure. As shown, the fuel command requires approximately 300 samples (i.e. the settling time) to stabilize the engine A/F equivalence ratio (EQR) to steady-state tracking after the 20% disturbance.

FIG. 3B, on the other hand, illustrates the PI control of the fuel command in response to a 20% disturbance with transfer operation of the present disclosure. As shown, the fuel command requires approximately 100 samples to stabilize the engine A/F EQR, or one-third of the settling time compared to FIG. 3A (no transfer operation). In other words, implementation of the transfer operation of the present disclosure may further decrease settling times after disturbances.

Referring again to FIG. 2, the fuel control module 90 receives the proportional correction P and the integral correction I. However, the fuel control module 90 may also receive other signals such as the desired EQR $EQR_{des}$ and the voltage $V_{err}$. The fuel control module 90 adjusts the fuel command to the engine 12 based on the proportional correction P and the integral correction I. For example, the fuel control module 90 may adjust the fuel command based on a weighted sum of the proportional correction P and the integral correction I. The fuel control module 90, however, may also adjust the fuel command based on the other signals, such as the desired EQR $EQR_{des}$ and/or the voltage $V_{err}$.

Figure 4:
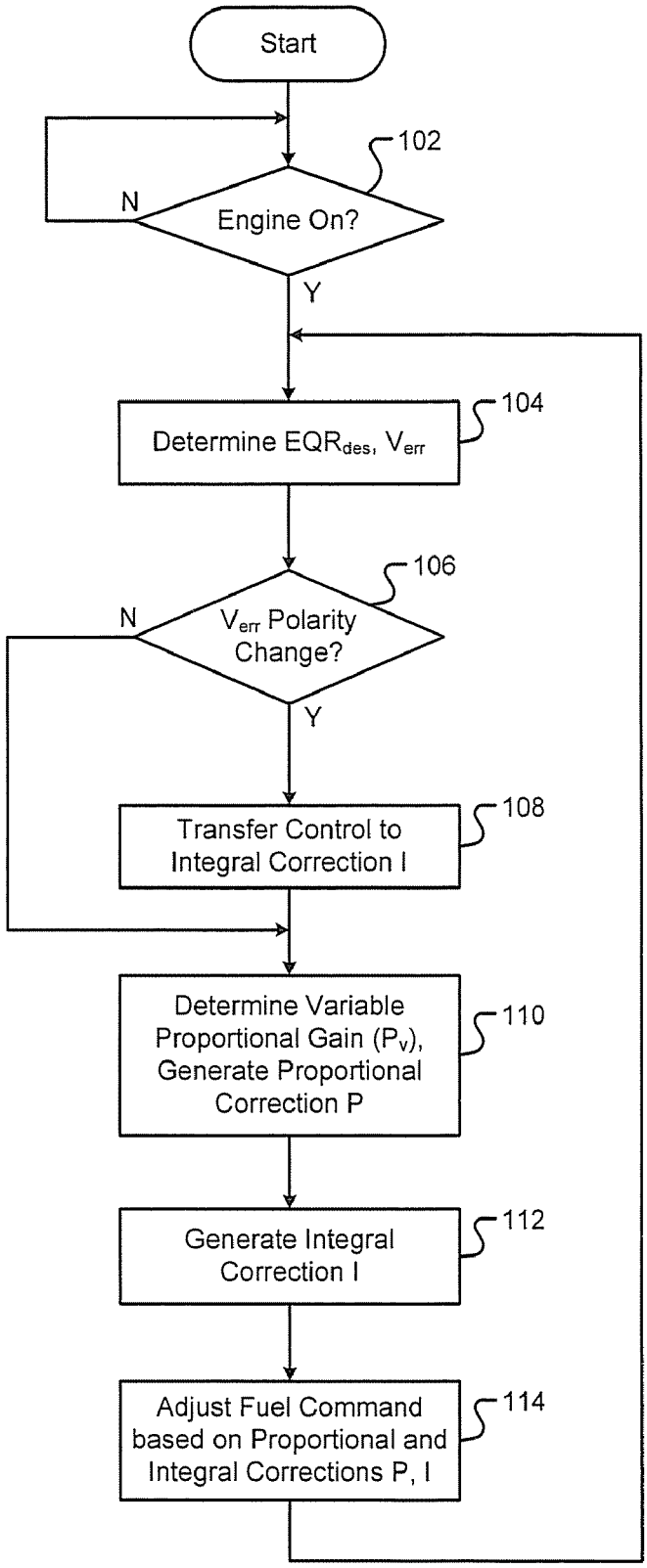
FIG. 4 is a flow diagram of an exemplary method for controlling an amount of fuel supplied to an engine according to the present disclosure.

Referring now to FIG. 4, a method for controlling fuel supplied to the engine 12 (i.e., the fuel command) begins in step 102. In step 102, the control module 40 determines whether the engine 12 is running. If true, control may proceed to step 104. If false, control may return to step 102.

In step 104, the control module 40 may determine the voltage $V_{err}$. In step 106, the control module 40 may determine whether the polarity of the voltage $V_{err}$ has changed. If true, control may proceed to step 108. If false, control may proceed to step 110.

In step 108, the control module 40 may generate the transfer signal T, which may set the third component of the integral correction I to zero (i.e., unless the transfer operation is performed). Additionally, in one embodiment the control module 40 may reset the time n (in number of engine events) to zero because the polarity of the voltage $V_{err}$ has changed.

In step 110, the control module 40 may determine the proportional gain $P_v$ and generate the proportional correction P using the proportional gain $P_v$. In step 112, the control module 40 may determine the integral correction I.

In step 114, the control module 40 may correct the fuel command based on the proportional correction P and the integral correction I. For example only, the control module 40 may correct the fuel command based on a weighted sum of the proportional correction P and the integral correction I. Control may then return to step 104.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a proportional correction module that generates a proportional correction for a fuel command to an engine based on a variable proportional gain and a difference between expected and measured amounts of oxygen in exhaust gas produced by the engine; and a variable proportional gain determination module that determines the variable proportional gain based on a nominal gain and an amount of time since a polarity of the difference has changed, wherein the nominal gain is based on engine operating parameters.

2. The engine control system of claim 1, further comprising:

a transfer module that generates a transfer signal when the polarity of the difference changes, wherein the transfer signal adjusts a component of an integral correction for the fuel command.

3. The engine control system of claim 2, further comprising:

an integral correction module that generates an integral correction for the fuel command to the engine based on an integral gain, the difference, and the transfer signal, wherein the integral gain is based on the engine operating parameters.

4. The engine control system of claim 3, wherein the engine operating parameters include at least one of intake manifold pressure (MAP) and engine speed.

5. The engine control system of claim 1, wherein the time since the polarity of the difference changed is based on a number of engine events.

6. The engine control system of claim 1, further comprising:

a desired equivalence ratio (EQR) determination module that determines a desired EQR of the engine based on at least one of intake MAP, engine speed, and an amount of oxygen in the exhaust gas at a location downstream from a catalyst.

7. The engine control system of claim 6, further comprising:

an error determination module that determines the difference based on the desired EQR and an amount of oxygen in the exhaust gas at a location upstream from the catalyst.

8. The engine control system of claim 7, wherein the difference includes a difference between first and second voltages, wherein the first voltage corresponds to the desired EQR and is indicative of the expected amount of oxygen in the exhaust gas at the location upstream from the catalyst, and wherein the second voltage is indicative of the measured amount of oxygen in the exhaust gas at the location upstream from the catalyst.

9. The engine control system of claim 3, further comprising:

a fuel control module that adjusts the fuel command to the engine based on the proportional correction and the integral correction.

10. The engine control system of claim 9, wherein the fuel control module adjusts the fuel command to the engine based on a weighted sum of the proportional correction and the integral correction.

11. A method, comprising:

generating a proportional correction for a fuel command to an engine based on a variable proportional gain and a difference between expected and measured amounts of oxygen in exhaust gas produced by the engine; and determining the variable proportional gain based on a nominal gain and an amount of time since a polarity of the difference has changed, wherein the nominal gain is based on engine operating parameters.

12. The method of claim 11, further comprising:

generating a transfer signal when the polarity of the difference changes, wherein the transfer signal adjusts a component of an integral correction for the fuel command.

13. The method of claim 12, further comprising:

generating an integral correction for the fuel command to the engine based on an integral gain, the difference, and the transfer signal, wherein the integral gain is based on the engine operating parameters.

14. The method of claim 13, wherein the engine operating parameters include at least one of intake manifold pressure (MAP) and engine speed.

15. The method of claim 11, wherein the time since the polarity of the difference changed is based on a number of engine events.

16. The method of claim 11, further comprising:

determining a desired equivalence ratio (EQR) of the engine based on at least one of intake MAP, engine speed, and an amount of oxygen in the exhaust gas at a location downstream from a catalyst.

17. The method of claim 16, further comprising:

determining the difference based on the desired EQR and an amount of oxygen in the exhaust gas at a location upstream from the catalyst.

18. The method of claim 17, wherein the difference includes a difference between first and second voltages, wherein the first voltage corresponds to the desired EQR and is indicative of the expected amount of oxygen in the exhaust gas at the location upstream from the catalyst, and wherein the second voltage is indicative of the measured amount of oxygen in the exhaust gas at the location upstream from the catalyst.

19. The method of claim 13, further comprising:

adjusting the fuel command to the engine based on the proportional correction and the integral correction.

20. The method of claim 19, further comprising:

adjusting the fuel command to the engine based on a weighted sum of the proportional correction and the integral correction.

* * * * *